United States Patent [19]

Schindehutte

[11] Patent Number: 4,503,638

[45] Date of Patent: Mar. 12, 1985

[54] SUSPENSION DEVICE FOR THE DOOR LEAF OF A SWING-OUT SLIDING DOOR FOR A VEHICLE, PARTICULARLY A RAIL VEHICLE

[75] Inventor: Manfred Schindehutte, Calden, Fed. Rep. of Germany

[73] Assignee: Gebr. Bode & Co. GmbH, Kassel, Fed. Rep. of Germany

[21] Appl. No.: 517,788

[22] Filed: Jul. 27, 1983

[30] Foreign Application Priority Data

Aug. 21, 1982 [DE] Fed. Rep. of Germany ..... 3231181

[51] Int. Cl.[3] ..... E05D 15/10

[52] U.S. Cl. ..... 49/213; 49/218; 49/225

[58] Field of Search ..... 49/213, 214, 215, 225, 49/218, 219

[56] References Cited

U.S. PATENT DOCUMENTS 4,152,872 5/1979 Tanizaki et al. ..... 49/214

4,157,846 6/1979 Whitcroft ..... 49/213 X

FOREIGN PATENT DOCUMENTS 2353411 5/1977 France .

*Primary Examiner*—Philip C. Kannan

*Attorney, Agent, or Firm*—Roberts, Spiecens & Cohen

[57] ABSTRACT

A suspension device for a door leaf of a swing out sliding door of a vehicle comprising a horizontal, fixed suspending member, a frame movable along the fixed suspending member and a swing arm connected to the frame for movement therewith. The swing arm is pivotably connected to the frame by a first hinge and the door leaf is connected by a second hinge to the swing arm. A roller is connected to the swing arm and is rollably supported in a fixed rail and a guide arm pivotably connected to the door leaf carries a third hinge pivotably connecting the guide arm to the frame. The fixed rail includes a curved end portion which controls movement of the roller to cause the door leaf to displace radially as the roller travels to and from the curved end portion.

10 Claims, 5 Drawing Figures

Fig. 1
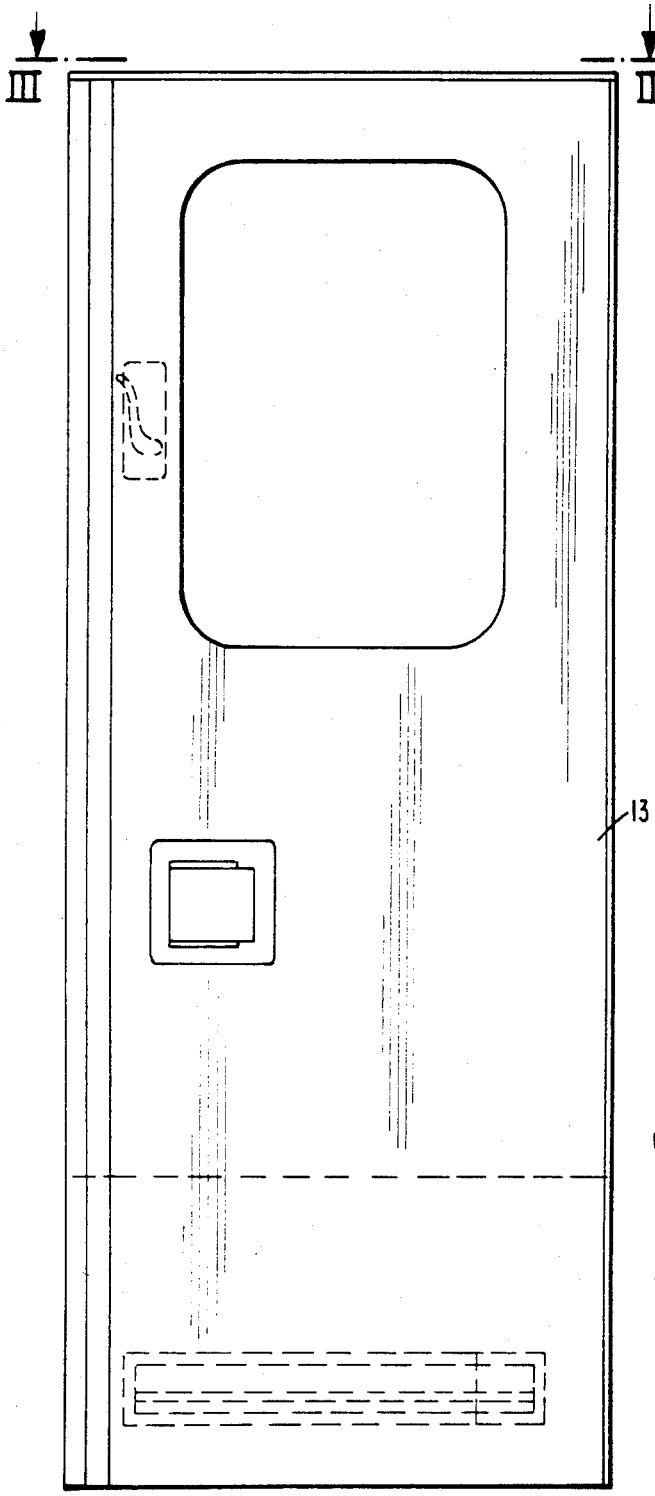
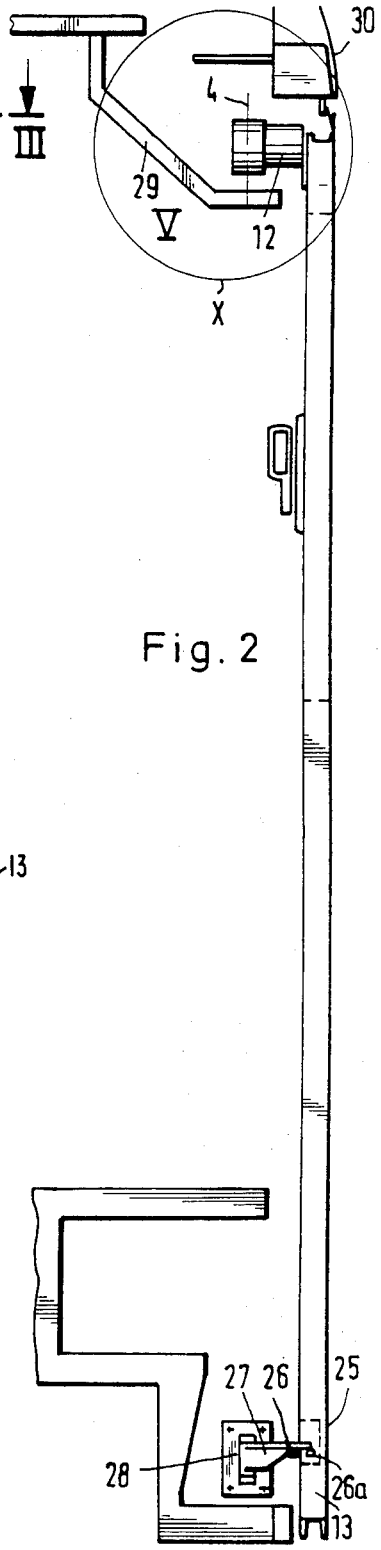
Fig. 2

SUSPENSION DEVICE FOR THE DOOR LEAF OF A SWING-OUT SLIDING DOOR FOR A VEHICLE, PARTICULARLY A RAIL VEHICLE

FIELD OF THE INVENTION

The invention relates to a suspension device for the door leaf of a swing-out sliding door for a vehicle, particularly a rail vehicle.

PRIOR ART

Vehicle doors are known, where the door leaf is supported and moved by a guide device. The guide device consists of two support arms which are rigidly connected to a vertical swivel column mounted on the vehicle. By swinging the guide device, the door leaf can swing over an arc of a circle laterally as well as outwardly so that the opening of the vehicle is generally cleared.

A second guide device is used for further control of the door leaf, so that the door leaf remains approximately in parallel position to the sidewall of the vehicle during the swinging motion.

By the arrangement of the swivel column inside the vehicle adjacent to the door opening near the sidewall of the vehicle and from the requirement that the door, in an open position, must clear the opening almost entirely, a number of characteristics are obtained which are typical of this type of door system.

The amount of angularity must be slightly less than 180°. The length of the guide device must be slightly larger than one-half the displacement of the door. The largest space of the door leaf when in half-open position is approximately equal to one-half the displacement of the door.

In many instances, particularly in the case of railroad vehicles, this space is unacceptable and thus makes the use of a simple door system impossible.

Other vehicle doors are known, where the door leaf is supported at three points by rollers running inside curved rails, so that the door is first inclined outwardly and then moved laterally. With these doors, at least one rail is situated outside the vehicle which may cause breakdowns, particularly under icing conditions.

Swing-out sliding doors are also known in which one rail is situated inside the sidewall of the vehicle and which cannot be curved due to lack of space; in such cases the door leaf can be swung open by means of a swing arm hinged at the door leaf, at the other end of which a train of rollers are arranged with hinges which run on a rail alongside the vehicle.

Other door suspensions are known, where two rocking levers are arranged parallel to one another with one end being rotatable around a vertical axis, and the other, which is also rotatable around a vertical axis, being fixed to a telescopic rail which supports the door. This has the disadvantage of high cost of construction for the telescopic rail.

SUMMARY OF THE INVENTION

An object of the invention is to provide a suspension device for the door leaf of a swing-out sliding door, particularly for a rail vehicle, whereby:

1. the swing-out motion of the door leaf does not extend too far from the wall of the vehicle body, 2. the vehicle body does not have any external guide elements, and 3. the door leaf, when in an open position, projects negligibly into the door opening.

According to this invention, the above and further objects are satisfied by hinging the door leaf at the pivot axle of a swing arm secured on a support axle, and by hinging the door leaf at the pivot axle of a guide arm secured by a support axle, so as to achieve parallel guidance of the door leaf, by fixing the support axle of the swing arm and the support axle of the guide arm on a horizontally slidable frame, and by providing a control roller for the swing-out motion of the swing arm, secured to the latter by means of an auxiliary arm, which roller runs in a fixed rail which at its end is curved.

With this arrangement, when the swing arm and the guide arm are short and the amount of angularity is low in comparison with the external swing door, it can be achieved that when the door leaf is swung out, the door leaf is not moved out too much from the wall of the vehicle body and, consequently, the acceptable maximum degree is not exceeded. Furthermore, this displacement of the support axle of the swing arm and the support axle of the guide arm on the horizontally slidable frame ensures that the maximum opening width is obtained so that only a small section of the door leaf extends into the door opening.

In further accordance with the invention, all guide elements of the suspension device are located inside the vehicle.

BRIEF DESCRIPTION OF THE FIGURES OF THE DRAWING

FIG. 1 is an exterior elevational view of the door without the suspension device.

FIG. 2 is a side view of the closed door with the suspension device illustrated only in part and diagrammatically.

DETAILED DESCRIPTION

Figure 3:
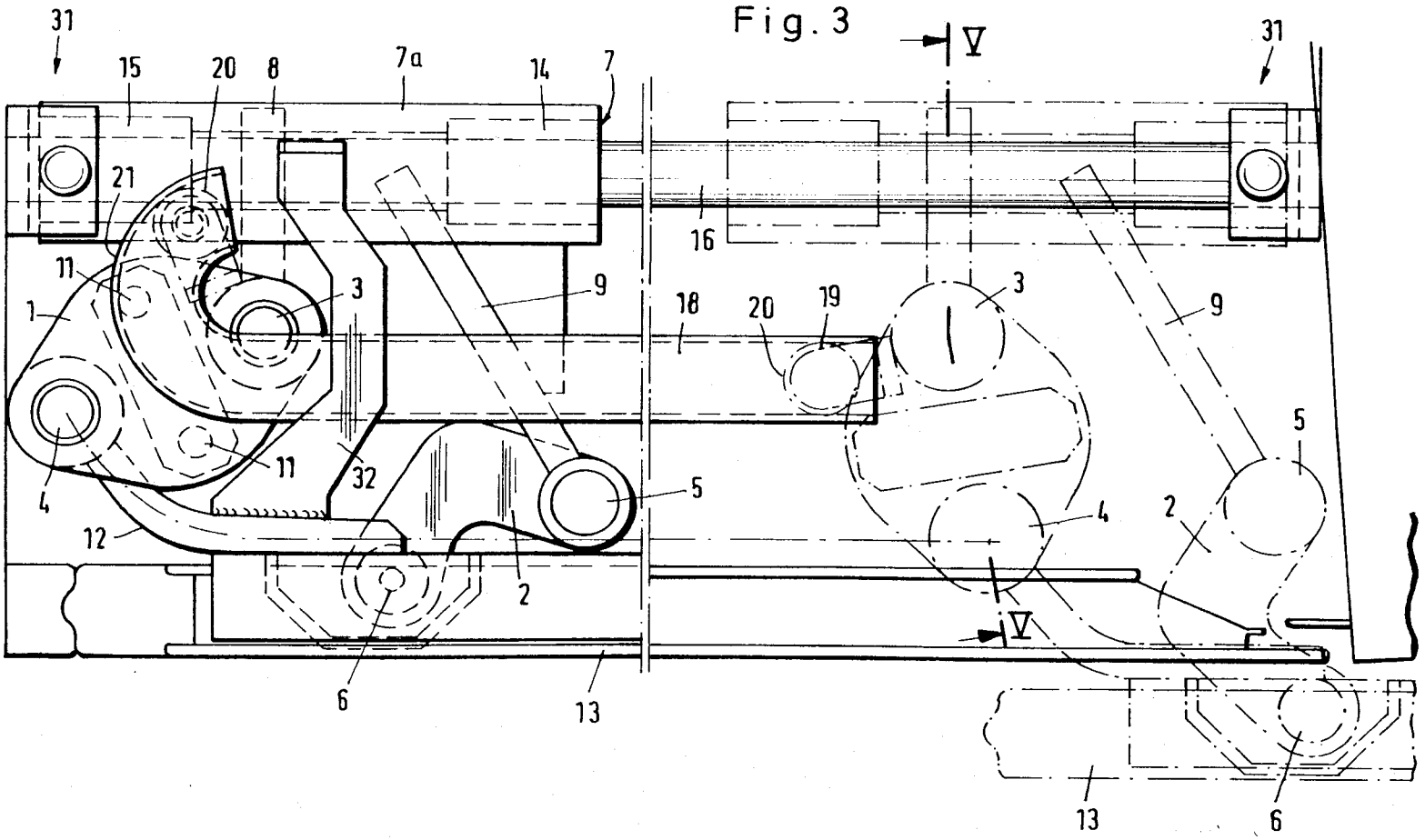
FIG. 3 is a cross-section, on enlarged scale, taken on line III—III in FIG. 1.
Figure 4:
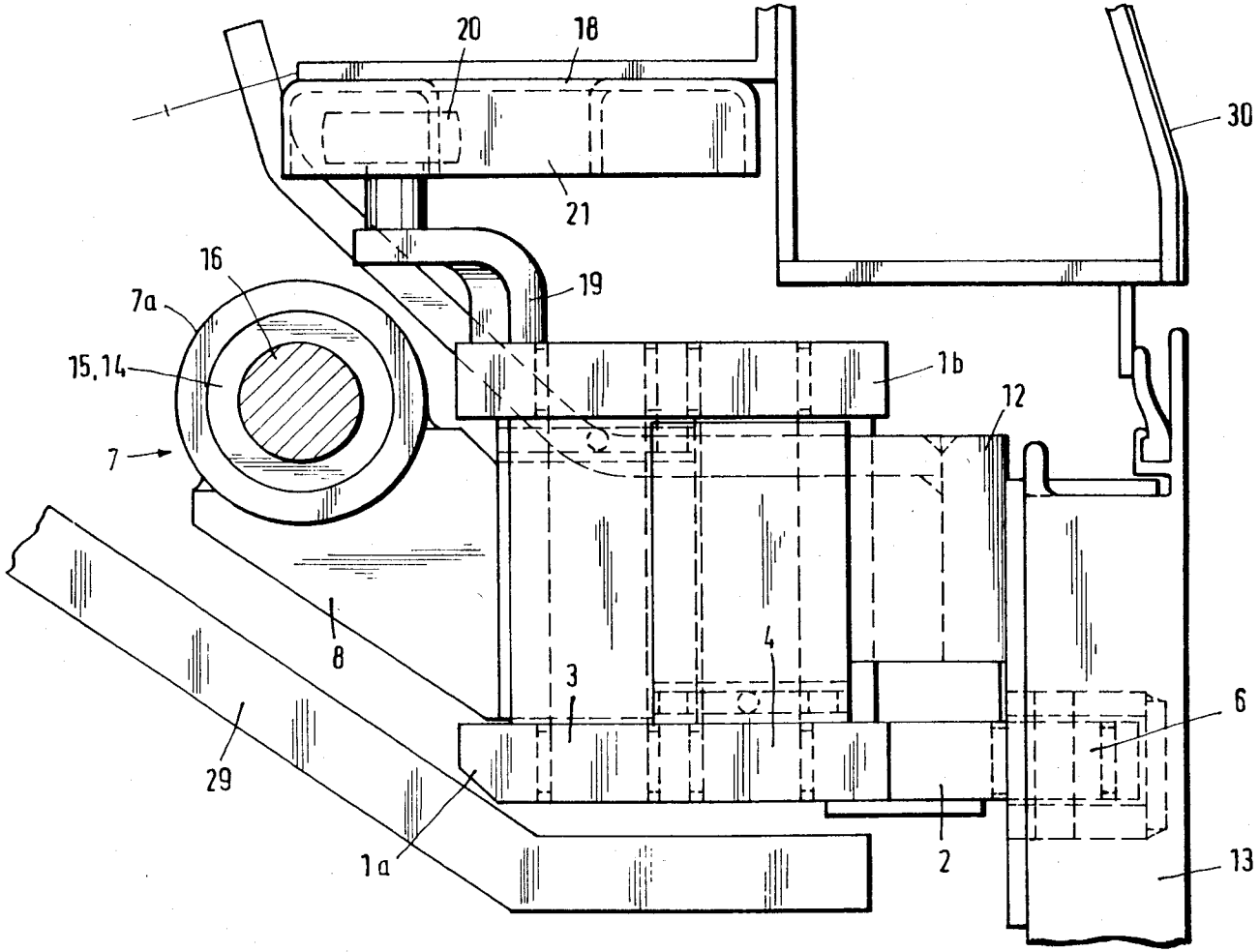
FIG. 4 is a side view of detail X, in FIG. 2, showing the suspension device on an enlarged scale.

Referring to the drawing, therein is seen a door leaf 13 which is movable between a closed position in which a door opening in a vehicle, such as a railroad car, is closed and an open position in which the door opening is substantially completely open. In traveling from the closed position to the open position, the door leaf 13 undergoes an initial movement radially outwards to clear the side wall of the vehicle whereafter the door travels laterally to overlay the side wall and leave the door opening substantially open.

In order to mount the door leaf on the vehicle and provide the desired movements in traveling between open and closed positions, the door leaf is suspended at the top by the suspension device of the invention, The suspension device comprises a swing arm 1 and a guide arm 2. The swing arm 1 is provided with a support axle 3 and a swivel axle 4. The guide arm 2 is provided with a support axle 5 and a swivel axle 6 which is housed within door leaf 13. The swing arm 1 and the guide arm 2 are fixed to a frame 7. The swing arm 1 and the guide arm 2 are fixed to the frame by a support 8 and a support element 9 respectively.

The swing arm 1 comprises a pair of spaced, interconnected plates 1*a* and 1*b*. The support axle 3 is rotatably supported at its ends in plates 1*a* and 1*b*. The axle 3 is secured to a bearing lug 10 mounted between the plates 1*a* and 1*b* and the lug 10 is secured to support 8 such that the plates can pivot around the axle 3. The plates 1*a* and 1*b* are interconnected by a bolt 11 situated in bores of spacers 11*a* and 11*b*. The swing arm 1 constituted by plates 1*a* and 1*b* supports the swivel axle 4 to which the door leaf 13 is hinged by means of a holder 12. The holder 12 comprises a curved plate having one end welded to an angle which is fixed to the door leaf 13.

Figure 5:
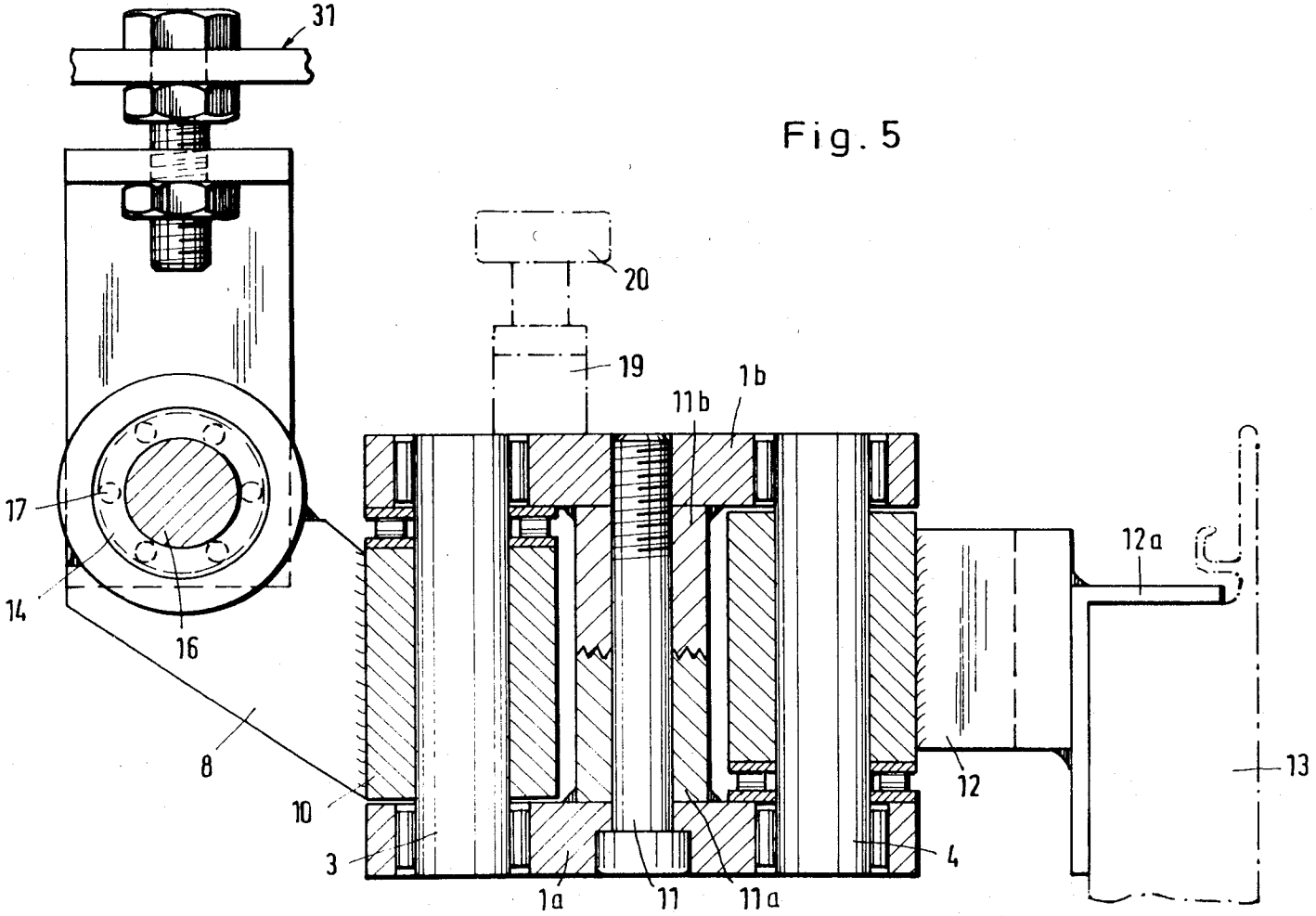
FIG. 5 is a cross-section taken on line V—V in FIG. 3 of the open door.

The frame 7 consists of a tube 7*a*, in which sleeves 14 and 15 are pressed, which are slidably mounted on a horizontally fixed suspension rod 16. As is illustrated in detail in FIG. 5, each sleeve on the suspension rod 16 is supported by balls 17.

In order to guide the door leaf during the opening and closing movements of the door leaf by means of the swing arm 1 and guide arm 2 along a given path, a rail 18 is fixed to the vehicle body above the swing arm and is in the form of a U-shaped rail open downwardly. A control roller 20 with a vertical axis is rotatably mounted on an auxiliary arm 19 fixed to the swing arm 1 such that the roller 20 is disposed above the swing arm. The roller 20 is rollably supported in the fixed rail 18. At its end, the rail 18 is curved at 21 over almost 180°.

During opening motion of the door leaf from the door opening, the control roller 20 will consequently move within the curved rear portion 21 and ensure that a sliding motion of the frame 7 is controlled on the suspension rod 16.

In view of the position of the support axles 3 and 5, the space required for the swing-out motion across the wall of the car body is restricted to a minimum, so that the door leaf is moved outwardly only by approximately 56 mm in front of the wall of the vehicle body. This is considered acceptable for rail vehicles. However, when the door leaf is in an open position, almost the entire width of the opening is exposed and accessible.

In order to provide further support for the door leaf at its lower end, the door leaf 13 is provided with a guide rail 25 in which travel rollers 26 and 26*a* which are fixed to a swing arm 27 which is rotatable around a shaft 28 such that the lower end of the door is supported while the door undergoes movement between the open and closed positions.

Parts 29 and 30 are molding elements of the vehicle body. The suspension rod 16 is secured in place on the vehicle body by means of supports 31.

As is illustrated in FIG. 3, a rigid arm 32 is fixed to the door leaf 13, approximately vertically, in an upper region of the door leaf to project above the door leaf. A drive means (not shown) engages the rigid arm 32 to move the door leaf.

From the above, it is seen that the invention provides a suspension device for the door leaf 13 of a swing out, sliding door of a vehicle which comprises horizontal fixed suspending member 16 on which frame 7 is movable. Swing arm 1 is connected to frame 7 for movement therewith and a first hinge means constituted by support axle 3 pivotably connects the swing arm and the frame. The door leaf is connected to the swing arm by means of holder 12 and a second hinge means constituted by swivel axle 4. Fixed rail 18 supports a roller means constituted by roller 20 connected to the swing arm. Guide arm 2 is pivotably connected to the door leaf at swivel axle 6 and the guide arm carries support axle 5 which constitutes a third hinge means which is connected by support element 9 to the frame 7. The curved end portion 21 of fixed rail 18 controls the movement of roller 20 to cause the door leaf to displace radially i.e. inwardly and outwardly of the door opening as the roller travels to and from the curved end portion.

In the straight portion of the rail 18, the door leaf 13 moves substantially parallel to the side wall while undergoing lateral travel.

Although the invention has been described in relation to a specific embodiment thereof, it will become apparent to those skilled in the art that numerous modifications and variations can be made within the scope and spirit of the invention as defined in the attached claims.

What is claimed is:

1. A suspension device for a door leaf of a swing out sliding door of a vehicle, said suspension device comprising a horizontal, fixed suspending member, a frame movable along said fixed suspending member, a swing arm connected to said frame for movement therewith, a first hinge means pivotably connecting said swing arm and said frame, means including a second hinge means pivotably connecting a door leaf to said swing arm, a fixed rail, roller means connected to said swing arm and rollably supported in said fixed rail, a guide arm pivotably connected to the door leaf, a third hinge means on said guide arm, and means connecting said third hinge means to said frame, said fixed rail including a curved end portion which controls movement of said roller means to cause the door leaf to displace radially as the roller means travels to and from said curved end portion.

2. A suspension device as claimed in claim 1 wherein said fixed rail includes a straight portion joined to said curved portion, said door leaf traveling along a straight path as said roller means traverses said straight portion of said fixed rail.

3. A suspension device as claimed in claim 2 wherein the vehicle has a door opening and said door leaf travels between a closed position and an open position, said roller means being disposed in said curved portion of said fixed rail in said closed position, said roller means moving from said curved portion to said straight portion as the door leaf moves from said closed position to said open position, said door leaf moving outwardly of the door opening and then laterally to expose said door opening as the roller means travels from said closed position to said open position.

4. A suspension device as claimed in claim 3 wherein said straight portion of the rail extends substantially parallel to the door opening.

5. A suspension device as claimed in claim 4 wherein said roller means is secured to said swing arm at a level thereabove.

6. A suspension device as claimed in claim 5 wherein said rail is disposed within the vehicle.

7. A suspension device as claimed in claim 1 wherein said fixed suspending member comprises a rod, said frame comprising a tube and a pair of sleeves secured in said tube, said sleeves being slidable on said rod.

8. A suspension device as claimed in claim 7 comprising ball means supporting said sleeve on said rod.

9. A suspension device as claimed in claim 1 wherein said swing arm comprises a pair of plates secured together in spaced relation, said first and second hinge means being rotatably supported by said pair of plates, and a support secured to said frame and said first hinge means.

10. A suspension device as claimed in claim 9 wherein said means connecting the door leaf to said swing arm comprises a holder secured to said door leaf and said second hinge means.

* * * * *